US009067459B2

(12) United States Patent
Bennet

(10) Patent No.: US 9,067,459 B2
(45) Date of Patent: Jun. 30, 2015

(54) MULTI-PURPOSE MATHEMATICAL DRAWING TEMPLATES SYSTEM

(71) Applicant: Brendan Bennet, Aptos, CA (US)

(72) Inventor: Brendan Bennet, Aptos, CA (US)

( * ) Notice: Subject to any disclaimer, the term of this patent is extended or adjusted under 35 U.S.C. 154(b) by 189 days.

(21) Appl. No.: 13/962,555

(22) Filed: Aug. 8, 2013

(65) Prior Publication Data

US 2014/0041245 A1 Feb. 13, 2014

Related U.S. Application Data

(60) Provisional application No. 61/680,818, filed on Aug. 8, 2012.

(51) Int. Cl.

*B43L 13/20* (2006.01)
*B43L 13/00* (2006.01)
*B43L 12/00* (2006.01)

(52) U.S. Cl.

CPC ..... *B43L 13/001* (2013.01); *B43L 12/00* (2013.01); *B43L 13/002* (2013.01); *B43L 13/205* (2013.01)

(58) Field of Classification Search

CPC ..... B43L 11/00; B43L 12/00; B43L 13/002; B43L 13/201; B43L 13/205; B44D 3/225
USPC ..... 33/19.3, 27.02, 32.1, 41.6, 562, 565, 33/566

See application file for complete search history.

(56) References Cited

U.S. PATENT DOCUMENTS

| | | | | |
|---|---|---|---|---|
| 6,321,457 | B1 * | 11/2001 | Lariviere et al. | 33/562 |
| 2003/0115767 | A1 * | 6/2003 | Wedekind et al. | 33/566 |
| 2006/0191150 | A1 * | 8/2006 | Sikora et al. | 33/566 |
| 2008/0022542 | A1 * | 1/2008 | Brosmith et al. | 33/562 |
| 2012/0151787 | A1 * | 6/2012 | Phillips | 33/484 |
| 2012/0210587 | A1 * | 8/2012 | Ostberg | 33/32.2 |
| 2012/0216734 | A1 * | 8/2012 | Platt | 33/562 |
| 2013/0102416 | A1 * | 4/2013 | Helms | 33/21.2 |
| 2014/0150273 | A1 * | 6/2014 | Bland | 33/565 |
| 2014/0223753 | A1 * | 8/2014 | Yaphe et al. | 33/566 |

* cited by examiner

*Primary Examiner* — G. Bradley Bennett

(74) *Attorney, Agent, or Firm* — Donald R. Boys; Central Coast Patent Agency, Inc.

(57) ABSTRACT

A drawing template set includes a planar anchor ring having an outer diameter and an inner diameter, a rotary increment scale marked at least part way along the outer diameter, and a first registration interface at at least one point on the inner diameter, and a planar template having an outer diameter providing a slip fit into the inner diameter of the planar anchor ring, one or more through slots or other openings enabling a user to draw specific lines and shapes on a drawing surface to which the template may be applied, and a second registration interface on the outer diameter matching the first registration interface of the planar anchor ring, enabling the user place the planar template in the anchor ring for use, to remove it as desired, and to replace it with a different template fashioned for a different purpose.

10 Claims, 7 Drawing Sheets

MULTI-PURPOSE MATHEMATICAL DRAWING TEMPLATES SYSTEM

CROSS-REFERENCE TO RELATED DOCUMENTS

The present application is a non-provisional application to provisional application 61/680,818, filed Aug. 8, 2012. Priority is claimed to the priority date of the parent application, and the entire disclosure of the parent application is incorporated herein at least by reference.

BACKGROUND OF THE INVENTION

1. Field of the Invention

The present invention is in the field of drawing and illustration tools, and pertains more particularly to templates for guiding a user in making drawings.

2. Description of Related Art

Drawing tools are well-known in the illustrating arts, and many commercial sets and individual tools are available. The field, however, is a very broad field, and there is always room for improvement, particularly in providing sets of drawing tools that may be used together to accomplish specific purposes in illustration.

BRIEF SUMMARY OF THE INVENTION

In an embodiment of the invention a drawing template set is provided, comprising a planar anchor ring having an outer diameter and an inner diameter, a rotary increment scale marked at least part way along the outer diameter, and a first registration interface at at least one point on the inner diameter, and a planar template having an outer diameter providing a slip fit into the inner diameter of the planar anchor ring, one or more through slots or other openings enabling a user to draw specific lines and shapes on a drawing surface to which the template may be applied, and a second registration interface on the outer diameter matching the first registration interface of the planar anchor ring, enabling the user place the planar template in the anchor ring for use, to remove it as desired, and to replace it with a different template fashioned for a different purpose.

In one embodiment the planar anchor ring further comprises a template removal port at at least one point along the inner diameter enabling the user to lift the planar template from the anchor template. In another embodiment the removal port is an angled slot enabling the user to engage the planar template with a fingertip or a fingernail. In another embodiment the anchor template comprises one or more through openings enabling a user to pin the anchor template to a drawing surface.

In yet another embodiment the anchor template comprises an undersurface having a coefficient of friction substantially greater than the coefficient of friction of the material of the anchor template. In some embodiments the slots or openings are fashioned to enable the user to draw graph axes in both the "X" and "Y" perpendicular directions and to mark increments along axes drawn, and slots at various angles, allowing the user to make lines at specific angles from one another. In other embodiments the slots or openings are fashioned to enable the user to draw mathematical function graphs including at least f(x)=sin X and f(x)=cosine x. In yet other embodiments the slots or openings are fashioned to enable the user to draw mathematical function graphs including at least f(x)=$X^2$ and f(x)=1/x. In still other embodiments the slots or openings are fashioned to enable the user to draw mathematical function graphs including at least (x)=x, f(x)=$e^x$ and f(x)=ln x., and in another embodiment the planar template lacks the registration interface, being free to rotate in the anchor ring, and comprises at least one straight slot enabling the user to draw straight lines on a drawing surface, and at least one engagement interface enabling the user to rotate the planar template to vary the angle of a line to be drawn using the straight slot.

DETAILED DESCRIPTION OF THE INVENTION

Figure 1:
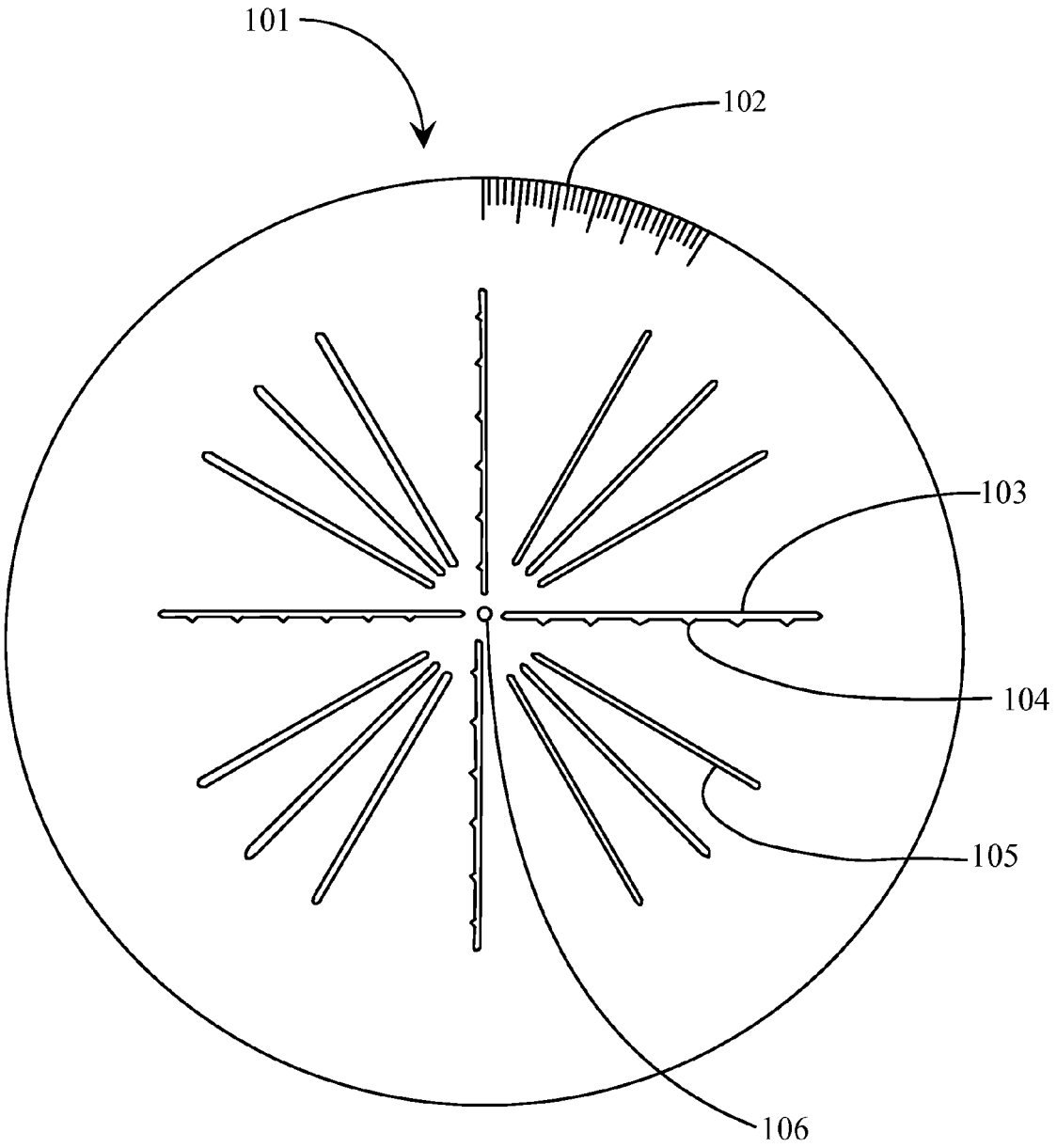
FIG. 1 illustrates a drawing template in one embodiment.

FIG. 1 is an illustration of a drawing template 101 according to an embodiment of the present invention. In this embodiment there is a degree measurement marker 102 which may also encircle the template and may measure 0.5 degree separations as in this embodiment, purposes of which include but may not be limited to measuring and drawing angles of varying sizes.

Drawing template 101 has in this embodiment axis drawing slots 103 one use of which is to facilitate accurate and speedy drawing of graph axes in both the "X" and "Y" perpendicular directions on a subject drawing. The axis drawing slots may incorporate scale marker indentions or markings 104 which enable speedy marking of drawn axes in usable scaling increments. Such markings may also be used to create Cartesian matrices. Additionally drawing template 101 has in this embodiment a plurality of angle drawing slots 105 to allow the user to draw quickly and easily common angles such as 30°, 45°, 60°, 120°, 135°, 150°, 210°, 225°, 240°, 300°, 315° and 330°. Drawing template 101 has a center drawing point hole 106 in this embodiment one use of which is to enable the user to mark the center of the graph, axes or other drawings being made. It may also be used to anchor the template to a drawing surface, and the template may then be rotated in either direction as needed without sliding across the drawing surface.

Figure 2:
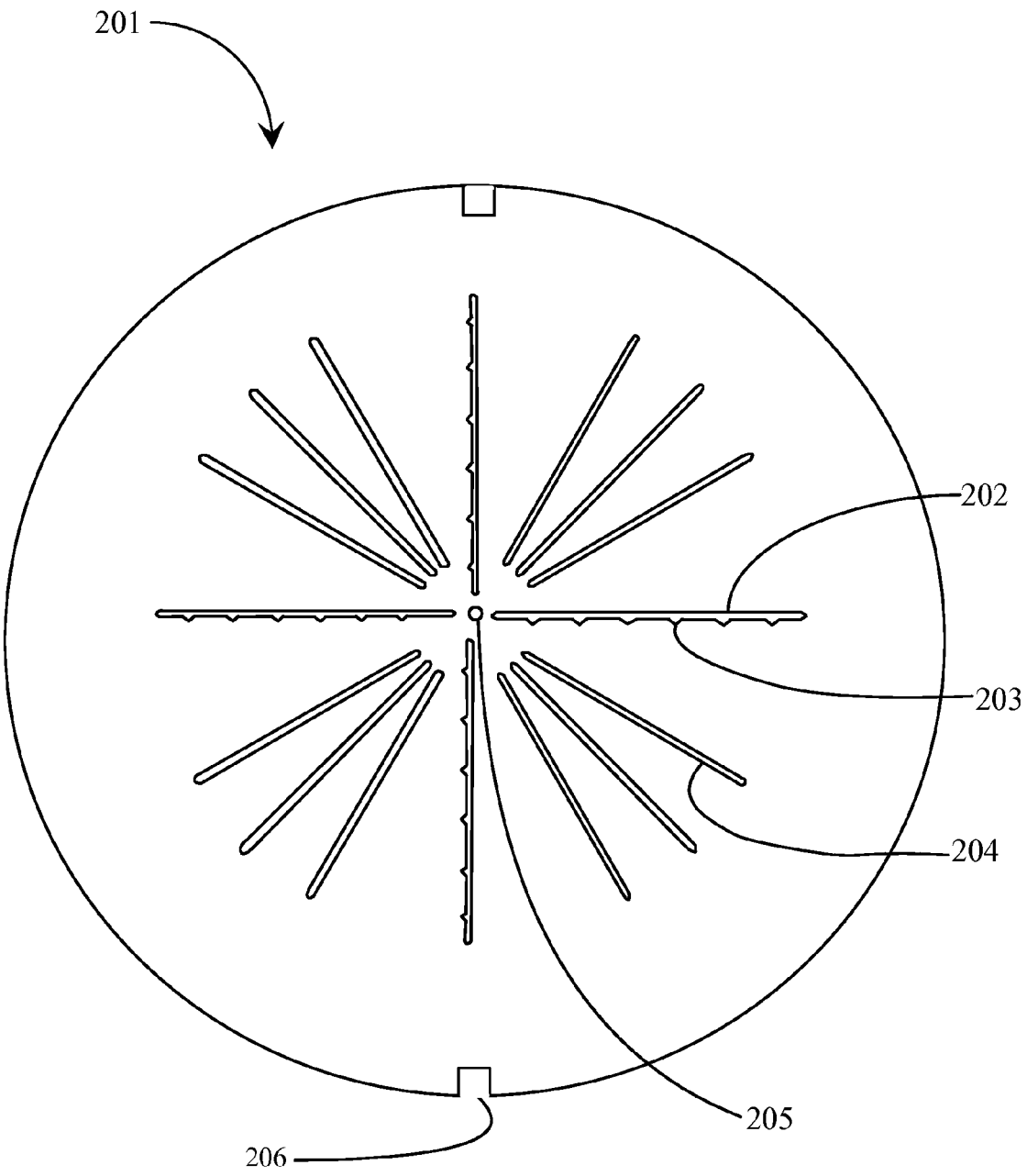
FIG. 2 illustrates a drawing template in another embodiment.

FIG. 2 is an illustration of a drawing template 201 according to another embodiment of the present invention. Drawing template 201 has in this embodiment axis drawing slots 202, one use of which is to facilitate the accurate and speedy drawing of graph axes in both the "X" and "Y" perpendicular directions on the plane. The axis drawing slots may incorporate scale marker devices 203, one purpose of which is to enable speedy marking of the axes' lines in usable scaling increments. Additionally drawing template 201 has in this embodiment angle drawing slots 204 one purpose of which is to allow the user to draw quickly and easily common angles such as 30°, 45°, 60°, 120°, 135°, 150°, 210°, 225°, 240°, 300°, 315° and 330°. Drawing template 201 has a center drawing point hole 205 in this embodiment one use of which is to enable the user to mark the center of the graph, axes or other drawings being made. This drawing template 201 has a synchronization point 206 which may be used to link and fix it to another template. The synchronization point may be a slot or indention, and is provided as an interface to other templates and template tools in an embodiment of the present invention.

Figure 3:
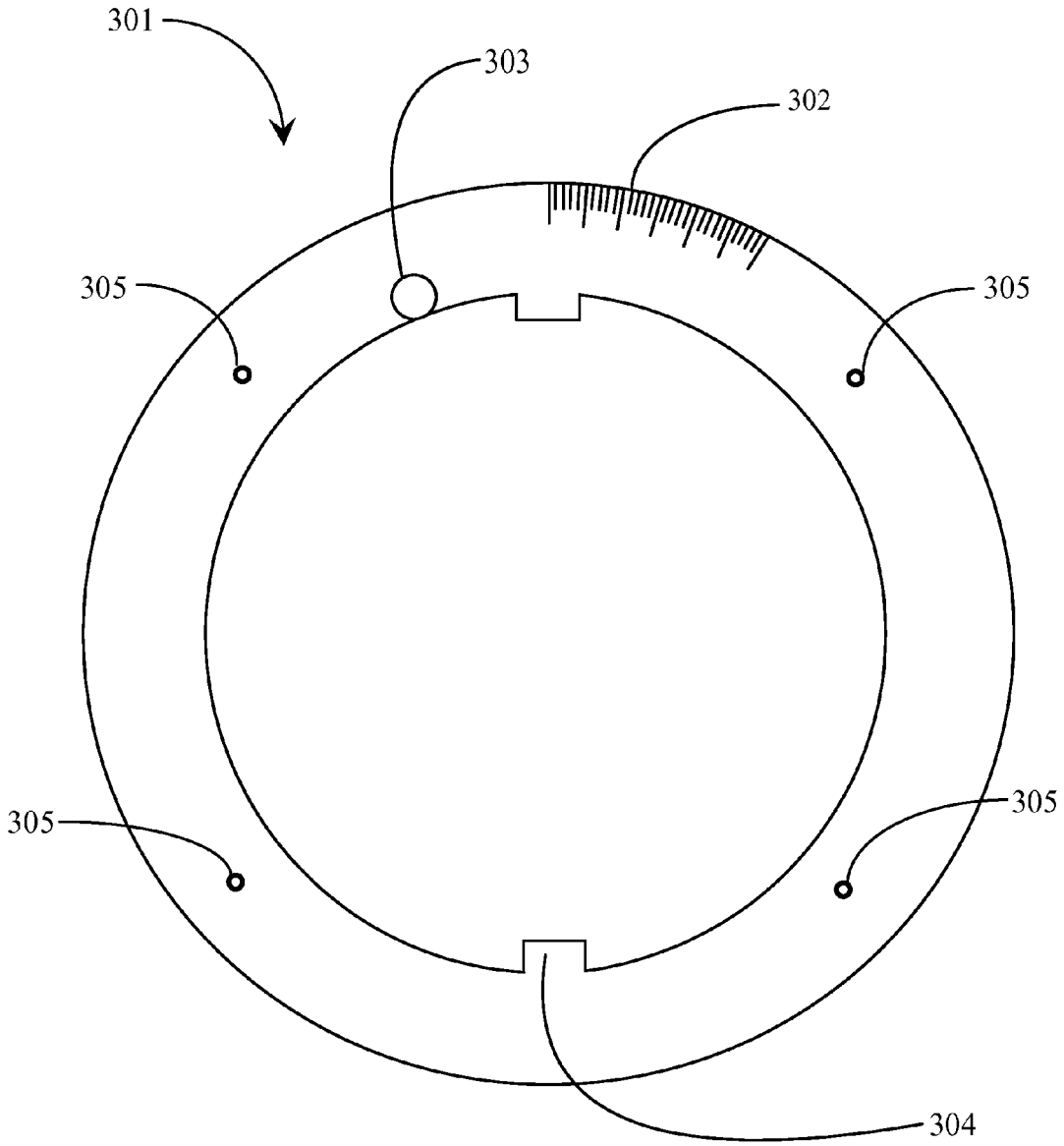
FIG. 3 illustrates a template-holder ring in an embodiment of the invention.

FIG. 3 is an illustration of an outer ring 301 according to still another embodiment of the present invention, one purpose of which is to receive and manage drawing templates. Outer ring 301 holds one or multiple templates for various and multiple tasks, typically one template at a time. In this embodiment there is a degree measurement marker 302 which may also encircle the outer ring and may measure 0.5 degree separations as in this embodiment purposes of which include but may not be limited to measuring and drawing angles of varying sizes.

Outer ring 301 has in this embodiment a template removal port 303, one use of which is to enable a linked template to be lifted out of the outer ring 301 without disturbing the placement of the outer ring 301. This removal port may be fashioned in a number of different ways, such as an angled cut that allows a user to use the fingertip or fingernail to contact a template that may be engaged by its outer diameter in the inner diameter of outer ring 301. Outer ring 301 also in this example comprises a synchronization point 304 as a matching interface to point 206 in FIG. 2, for example, which may be used to link and fix it to another template inserted into the center and possibly to align it with the accumulated work of other utilized templates.

The shape and nature of the synchronization points on the ring of FIG. 3 and on other templates illustrated and described may be of a variety of shapes and sizes, as long as the interface on one securely engages the interface on the other to be mated. A rectangular slot is shown for one, and a rectangular extension for the other, but these may be, for example, semicircular, or of some other shape.

Outer ring 301 also has in this example one or more anchor holes 305 that may be used to anchor the ring to a drawing surface to hold it in place and to facilitate use with other templates, holding those templates in place as well. In other embodiments an undersurface may be added that has a higher friction coefficient than the plastic of the ring, to help hold the ring in place.

Figure 4:
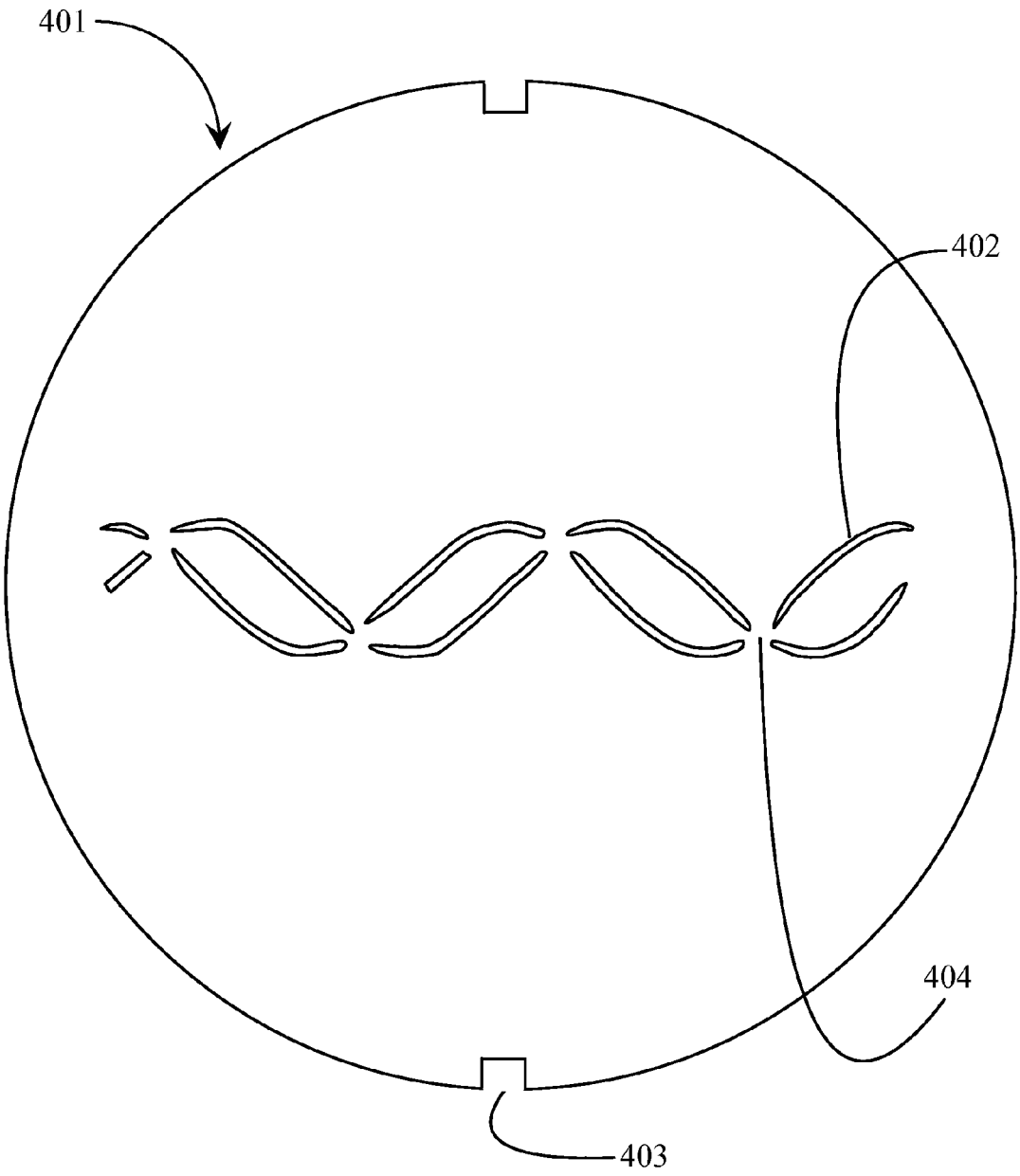
FIG. 4 illustrates a template-holder ring in an embodiment of the invention.

FIG. 4 is an illustration of a drawing template 401 according to yet another embodiment of the present invention. Drawing template 401 has in this embodiment functional drawing slots 402 one use of which is to facilitate accurate and speedy drawing of mathematical functions' graphs such as f(x)=sin X and f(x)=cosine x. This drawing template 401 has a synchronization point 403 which may be used to link and fix it to another template and has a stabilization point 404 several of which are shown in this embodiment. The stabilization points are to retain the physical integrity of the template.

Figure 5:
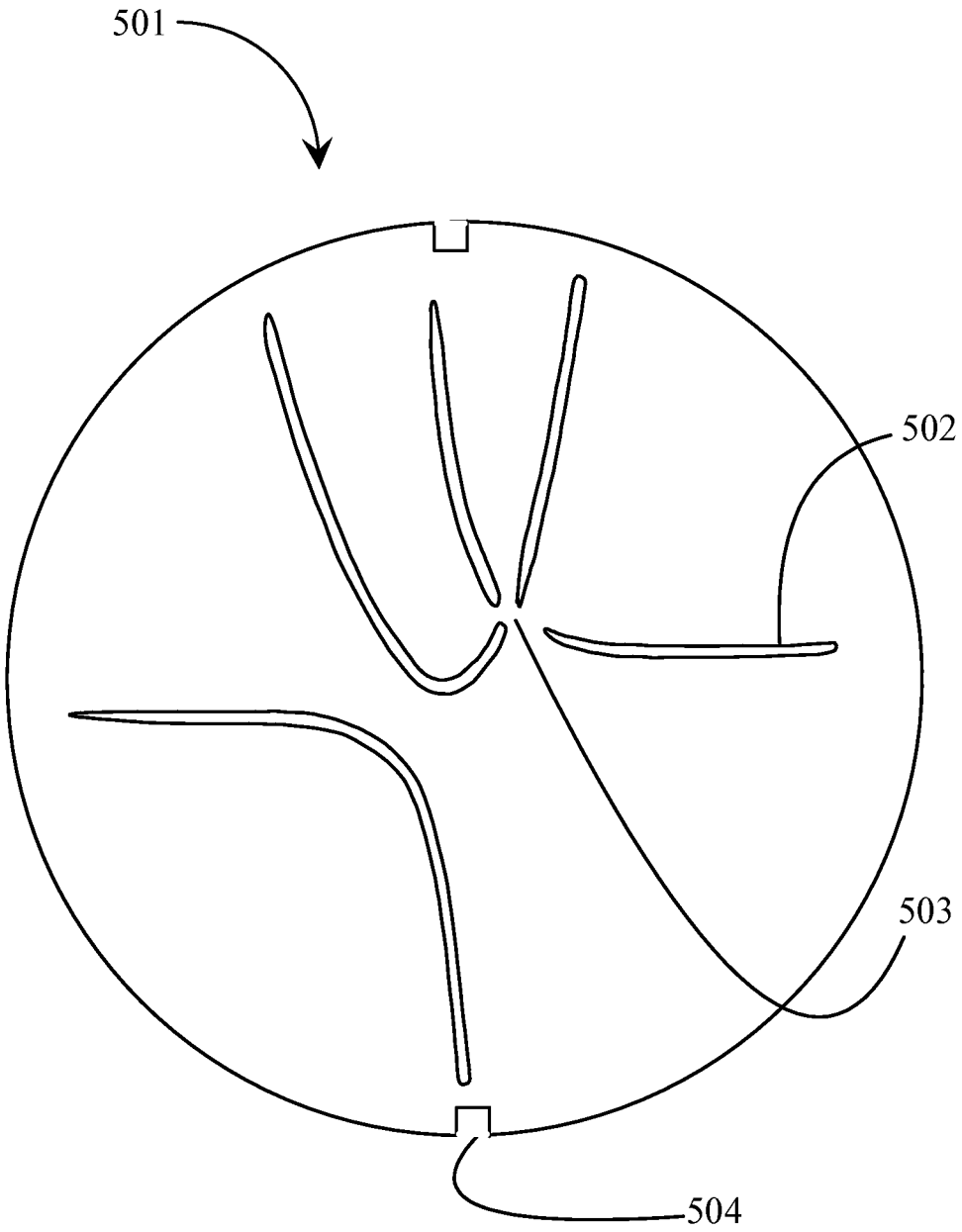
FIG. 5 illustrates a template-holder ring in an embodiment of the invention.

FIG. 5 is an illustration of a drawing template 501 according to another embodiment of the present invention. Drawing template 501 has in this embodiment function drawing slots 502, one use of which is to facilitate the accurate and speedy drawing of mathematical functions' graphs $f(x)=X^2$ and f(x)=1/x. This drawing template 501 has a synchronization point 504 which may be used to link and fix it to another template and has a stabilization point 503 one of which is shown in this embodiment.

Figure 6:
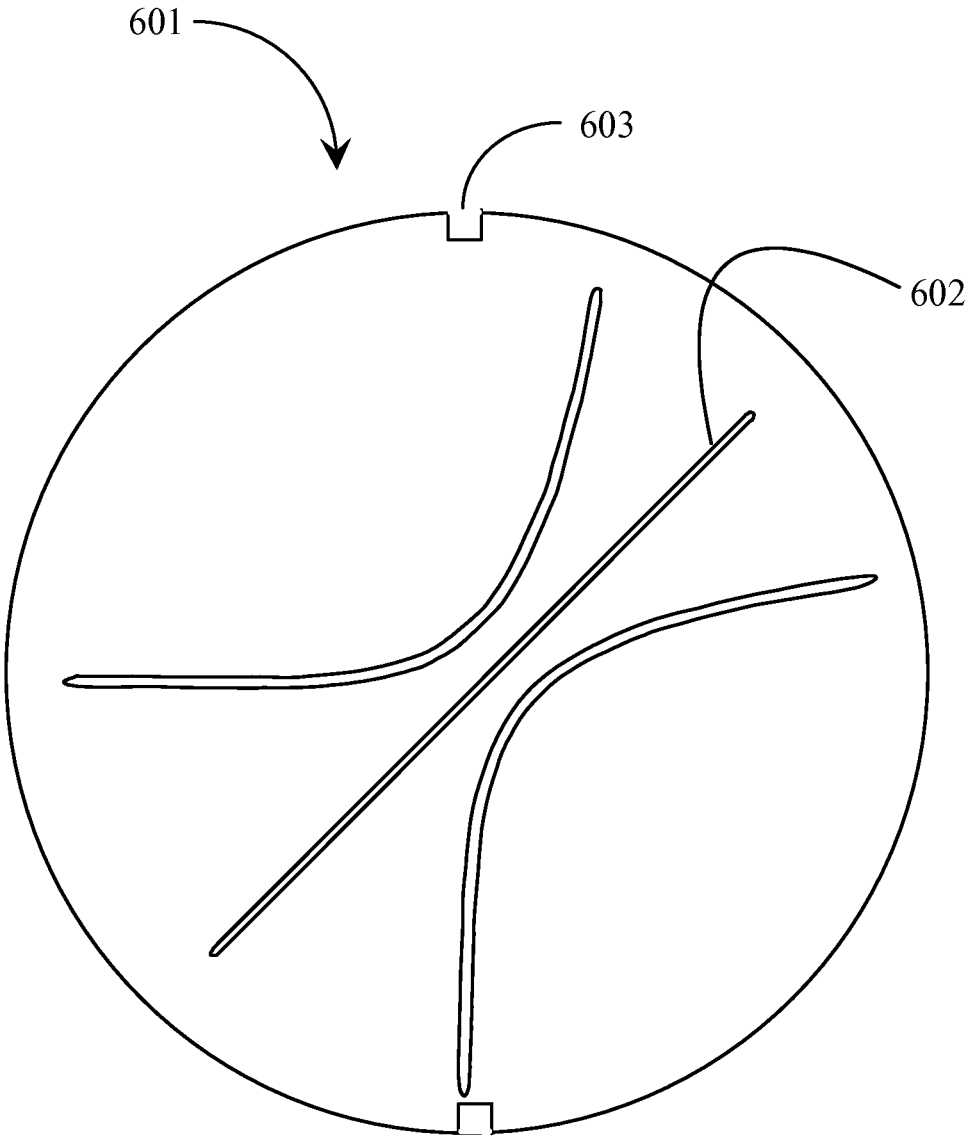
FIG. 6 illustrates a template-holder ring in an embodiment of the invention.

FIG. 6 is an illustration of a drawing template 601 according to yet another embodiment of the present invention. Drawing template 601 has in this embodiment function drawing slots 602, one use of which is to facilitate the accurate and speedy drawing of mathematical functions' graphs f(x)=x, $f(x)=e^x$ and f(x)=ln x. This drawing template 601 has a synchronization point 603 which may be used to link and fix it to another template.

Figure 7:
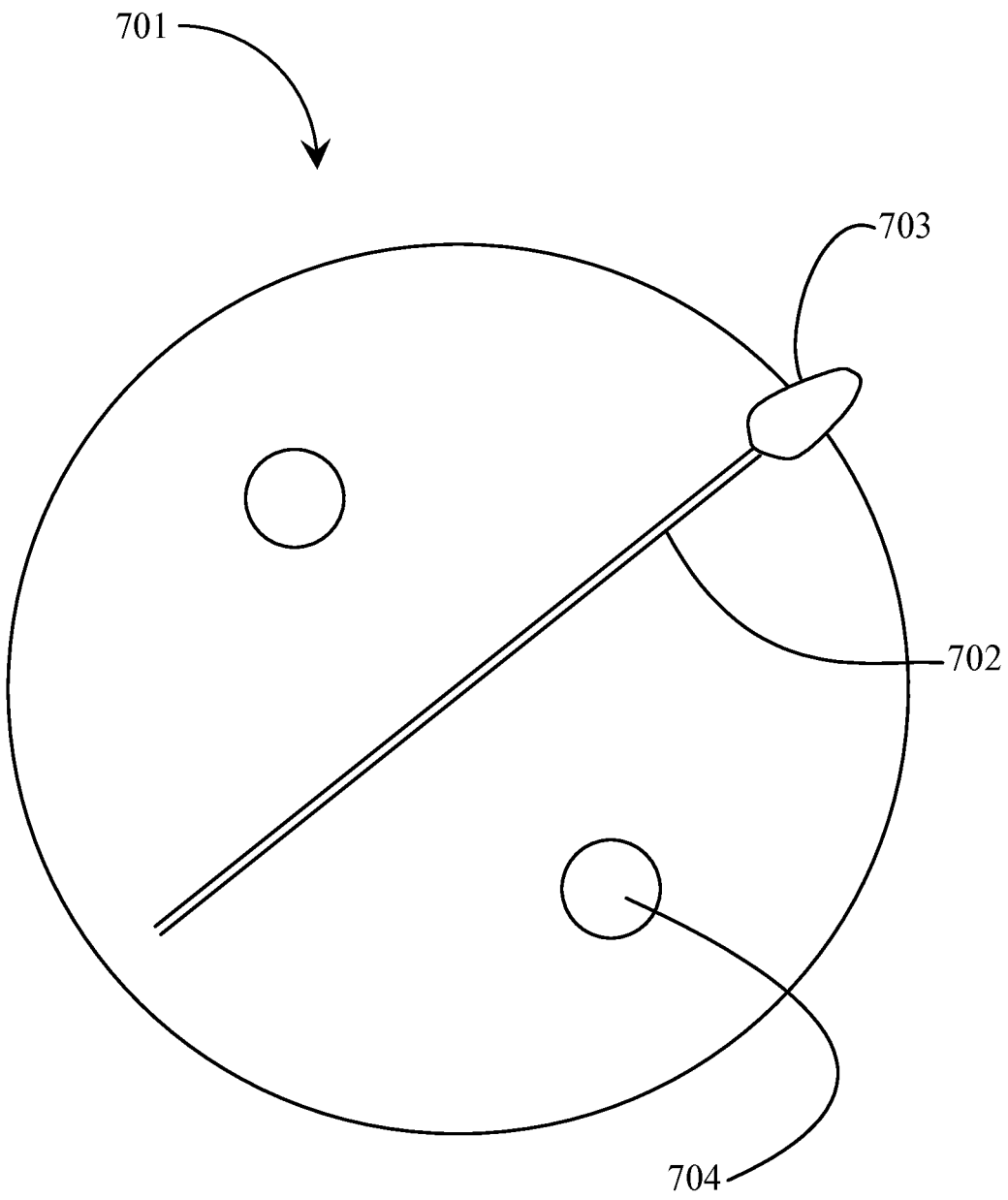
FIG. 7 illustrates a template-holder ring in an embodiment of the invention.

FIG. 7 is an illustration of a drawing template 701 according to yet another embodiment of the present invention. Drawing template 701 has in this embodiment a drawing slot 702, one use of which is to facilitate accurate and speedy drawing of any angle to + or −0.5°. This drawing template 701 has a pointer 703 which may be used to select an angle measurement for drawing. A finger access hole 704 of which two are shown in this embodiment may be used to turn the free moving template within the outer ring 301.

The drawing templates 101, 201, 401, 501, 601, 701 and the outer ring 301 may be made from any one of a number of materials or combination of materials such as plastics, poly carbonate, wood or steel for example depending at least in part on material costs, rigidity, tensile strength, coloring requirements and ability to withstand UV rays.

It will be apparent to the skilled person that there are a variety of ways the templates and ring in this set may be fashioned to perform closely the functions intended by the inventor, with minor variations in size, materials, shape, and so on. The embodiments described above are exemplary only, and the scope of the invention is limited only by the claims that follow.

The invention claimed is:

1. A drawing template set, comprising:

a planar anchor ring having an outer diameter and an inner diameter, a rotary increment scale marked at least part way along the outer diameter, and a first registration interface at at least one point on the inner diameter; and a planar template having an outer diameter providing a slip fit into the inner diameter of the planar anchor ring, one or more through slots or other openings enabling a user to draw specific lines and shapes on a drawing surface to which the template may be applied, and a second registration interface on the outer diameter matching the first registration interface of the planar anchor ring, enabling the user place the planar template in the anchor ring for use, to remove it as desired, and to replace it with a different template fashioned for a different purpose.

2. The drawing template set of claim 1 wherein the planar anchor ring further comprises a template removal port at at least one point along the inner diameter enabling the user to lift the planar template from the anchor template.

3. The drawing template set of claim 2 wherein the removal port is an angled slot enabling the user to engage the planar template with a fingertip or a fingernail.

4. The drawing template set of claim 1 wherein the anchor template comprises one or more through openings enabling a user to pin the anchor template to a drawing surface.

5. The drawing template set of claim 1 wherein the anchor template comprises an undersurface having a coefficient of friction substantially greater than the coefficient of friction of the material of the anchor template.

6. The drawing template set of claim 1 wherein the slots or openings are fashioned to enable the user to draw graph axes in both the "X" and "Y" perpendicular directions and to mark increments along axes drawn, and slots at various angles, allowing the user to make lines at specific angles from one another.

7. The drawing template set of claim 1 wherein the slots or openings are fashioned to enable the user to draw mathematical function graphs including at least f(x)=sin X and f(x)=cosine x.

8. The drawing template set of claim 1 wherein the slots or openings are fashioned to enable the user to draw mathematical function graphs including at least $f(x)=X^2$ and $f(x)=1/x$.

9. The drawing template set of claim 1 wherein the slots or openings are fashioned to enable the user to draw mathematical function graphs including at least $(x)=x$, $f(x)=e^x$ and $f(x)=\ln x$.

10. The drawing template set of claim 1 wherein the planar template lacks the registration interface, being free to rotate in the anchor ring, and comprises at least one straight slot enabling the user to draw straight lines on a drawing surface, and at least one engagement interface enabling the user to rotate the planar template to vary the angle of a line to be drawn using the straight slot.

* * * * *